252-99 AU 165 EX
10/12/76 OR 3,985,668

United States Patent [19]

Hartman

[11] 3,985,668

[45] Oct. 12, 1976

[54] SCOURING COMPOSITIONS

[75] Inventor: William Law Hartman, Cheviot, Ohio

[73] Assignee: The Procter & Gamble Company, Cincinnati, Ohio

[22] Filed: Sept. 9, 1974

[21] Appl. No.: 504,218

[30] Foreign Application Priority Data

Apr. 17, 1974 United Kingdom ..... 16814/74

[52] U.S. Cl. ..... 252/99; 252/103; 252/160; 252/546; 252/550

[51] Int. Cl.[2] ..... C11D 7/54

[58] Field of Search ..... 252/99, 103, 160, 550, 252/546, DIG. 14

[56] References Cited

UNITED STATES PATENTS

| | | | |
|---|---|---|---|
| 2,489,848 | 11/1949 | Bacon et al. | 252/160 |
| 3,042,622 | 7/1962 | Kirschtnauer | 252/99 |
| 3,446,893 | 5/1969 | Hanford et al. | 252/99 X |
| 3,530,071 | 9/1970 | Moore | 252/99 |
| 3,558,496 | 1/1971 | Zmoda | 252/99 X |
| 3,702,826 | 11/1972 | Koceich et al. | 252/99 |
| 3,715,314 | 2/1973 | Morgenstern | 252/99 X |
| 3,716,488 | 2/1973 | Kolsky et al. | 252/160 X |

*Primary Examiner*—Mayer Weinblatt
*Attorney, Agent, or Firm*—Ronald L. Hemingway; George W. Allen; Richard C. Witte

[57] ABSTRACT

Stable, false body hard surface cleansers containing a false body fluid phase; relatively heavy abrasive particulate material suspended throughout the false body fluid phase and relatively light particulate filler material also suspended throughout the false body fluid phase. Such compositions can remain for extended periods of time as homogenous false body compositions exhibiting minimal tendency to form a separate liquid phase layer.

11 Claims, No Drawings

SCOURING COMPOSITIONS

BACKGROUND OF THE INVENTION

The instant invention relates to semi-liquid, i.e. false body, fluid abrasive scouring compositions. The false body properties are realized by preparing a false body fluid phase from an aqueous liquid and an appropriate colloid-forming agent such as clay. Abrasive scouring materials are then suspended throughout the false body phase and relatively light filler material is added to minimize phase separation of the false body compositions.

Abrasive, hard surface cleansers in a liquid or semi-liquid form provide a convenient and useful means for carrying out ordinary household cleaning. Formulation of abrasive-containing fluid compositions, however, presents problems by virtue of the difficulty in uniformly suspending or dispersing the relatively high density abrasive material throughout a fluid scouring composition. Attempts to solve the abrasive distribution problem have been made in the prior art through utilization of a wide variety of thickening or suspending agents in liquid or semi-liquid abrasive-containing compositions.

Abrasive suspended in or distributed throughout a thickened liquid cleansing composition, however, promote phase separation within the fluid product by exerting a downward force on the thickened or colloidal fluid structure used to support and suspend the abrasive material. This action tends to "squeeze" liquid from the thickened fluid structure thereby forming a clear liquid layer at the top of the container holding the abrasive cleaning product. This problem is aggravated when such compositions must stand without agitation for prolonged periods of time during shipping and storage. This problem is also aggravated if the scouring compositions contain such chemically active ingredients as bleaches and/or surfactants which tend to degrade and render less effective the suspending agents for the abrasive material.

Although the tendency of fluid, abrasive-containing compositions to separate and form an undesirable liquid layer can be minimized by selection of particular composition ingredients (See, for example, McClain et al, U.S. Pat. No. 3,630,922, issued Dec. 28, 1971; Cambre, U.S. Pat. No. 3,623,990, issued Nov. 30, 1971; and U.S. Pat. application of William L. Hartman having Ser. No. 415,033, filed Nov. 12, 1973 and the concurrently filed U.S. Pat. application of William L, Hartman, having Ser. No. 504,217, filed Sept. 9, 1974; there is a continuing need for fluid abrasive compositions able to withstand lengthy storage of shipping periods without undergoing an undesirable separation of fluid phases.

Accordingly, it is an object of the present invention to provide homogenous, fluid, abrasive-containing scouring compositions having reduced tendency to form a liquid layer at the top of a container holding such compositions.

It is a further object of the present invention to provide such an abrasive scouring composition which can contain chemically active bleaching and surfactant materials without adversely affecting the abrasive suspending capability or phase stability of such compositions.

It has been surprisingly discovered that by utilizing abrasive and particulate filler material having very particular physical characteristics in certain false body fluid scouring compositions, the above objectives can be accomplished and abrasive hard surface cleansing products can be formulated which are unexpectedly superior to similar compositions of the prior art.

SUMMARY OF THE INVENTION

The instant false body hard surface scouring cleanser compositions comprise a false body fluid phase formed from an aqueous liquid and a colloid-forming agent; relatively heavy abrasive material suspended throughout this false body fluid phase and relatively light particulate filler material also suspended throughout the false body fluid phase.

The aqueous liquid used to form the false body fluid phase comprises from about 30% to 90% by weight of the total composition and the colloid-forming agent used to form the false body fluid phase comprises from about 1% to 10% by weight of the total composition.

The relatively heavy particulate abrasive material has diameters ranging between one and 250 microns, has specific gravity equal to or greater than that of the false body fluid phase and is present to the extent of from about 2% to 60% by weight of the total composition.

The relatively light particulate filler material has diameters ranging between one and 250 microns; has specific gravity less than that of the false body fluid phase and is present to the extent of from about 1% to 15% by weight of the total composition. Further, the ratio of the average particle diameter of the relatively heavy abrasive material to the average particle diameter of the relatively light filler material ranges between about 0.25:1 and 2.0:1.

The instant compositions can optionally contain a wide variety of bleaching agents, surfactants, buffering agents, builders and other such materials dissolved in the aqueous liquid used to form the false body fluid phase.

DETAILED DESCRIPTION OF THE INVENTION

The aqueous false body scouring compositions of the instant invention contain three essential components, i.e., a continuous false body phase formed from an aqueous liquid and a colloid-forming agent, a relatively heavy abrasive material and a relatively light particulate filler material. Each of these essential composition components, as well as a wide variety of optional materials and composition preparation, are discussed in detail as follows:

FALSE BODY FLUID PHASE

The scouring compositions of the instant invention are false bodied in nature. "False body" fluids are related to but are not identical to fluids having thixotropic properties. True thixotropic materials break down completely under the influence of high stresses and behave like true liquids even after the stress has been removed. False-bodied materials, on the other hand, do not, after stress removal, lose their colloidal properties entirely and can still exhibit a yield value even though it might be diminished. The original yield value is regained only after such fluids are at rest for considerable lengths of time.

The instant false-body mixtures in a quiescent state are highly viscous, are Bingham plastic in nature, and have relatively high yield values. When subjected to shear stresses, however, such as being shaken in a bottle or squeezed through an orifice, the instant compositions fluidize and can be easily dispensed. When the shear stress is stopped, the instant false body compositions quickly revert to a high viscosity/Bingham plastic state.

The false body character of the instant compositions is realized by the essential presence in such compositions of a flase body fluid phase. This false body fluid phase is formed by admixing with appropriate shear agitation an aqueous liquid with a colloid-forming agent.

AQUEOUS LIQUID

An aqueous liquid is the medium in which the colloid-forming agent is suspended to form the false body fluid phase of the instant compositions. Water is the principal component of the aqueous liquid although, as discussed below, the aqueous liquid can contain a number of optional components dissolved within it. It is preferred that the water employed in the aqueous liquid component of the false body fluid phase be "soft" or deionized. This prevents interaction between impurities in the water and many of the optional components preferably employed in the present scouring compositions.

The aqueous liquid is present in the instant false body fluid phase to the extent of from about 30% to 90% by weight, preferably from about 55% to 90% by weight, of the total composition.

COLLOID-FORMING AGENT

Any agent which can be admixed with water to form a false body fluid can be utilized in the present compositions to form the requisite false body fluid phase. These include many of the inorganic or organic materials generally recognized in the art as thickening or suspending agents.

The most preferred colloid-forming agents for use herein are the inorganic colloid-forming clays selected from the group consisting of smectites, attapulgites and mixtures of smectites and attapulgites. These clay materials which function in the instant compositions as colloid-forming agents can be described as expandable layered clays, i.e., aluminoscilicates and magnesium silicates. The term "expandable" as used to describe the instant clays relates to the ability of the layered clay structure to be swollen, or expanded, on contact with water. As noted, these expandable clays preferably used herein are those materials classified geologically as smectites (or montmorillonoids) and attapulgites (or palygorskites).

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atomic substitution by iron and magnesium can occur within the crystal lattice of the smectites, while metal cations such as $Na^+$, $Ca^{++}$, as well as $H^+$, can be copresent in the water of hydration to provide electrical neutrality. Although the presence of iron in such clay material is preferably avoided to minimize chemical interaction between clay and optional composition components, such cation substitutions in general are immaterial to the use of the clays herein since the desirable physical properties of the clay are not substantially altered thereby.

The layered expandable aluminosilicate smectite clays useful herein are further characterized by a dioctahedral crystal lattice, whereas the expandable magnesium silicate smectite clays have a trioctahedral crystal lattice.

The smectite clays used in the compositions herein are all commercially available. Such clays include, for example, montmorillonite (bentonite), volchonskoite, nontronite, beidellite, hectorite, saponite, sauconite and vermiculite. The clays herein are available under commercial names such as "Fooler Clay" (clay found in a relatively thin vein above the main bentonite or montmorillonite veins in the Black Hills) and various trade names such as Thixogel No. 1 and Gelwhite GP from Georgia Kaolin Company, Elizabeth, New Jersey (both montmorillonites); Volclay BC and Volclay No. 325, from American Colloid Company, Skokie, Illinois; Black Hills Bentonite BH 450, from International Minerals and Chemicals; Veegum Pro and Veegum F, from R. T. Vanderbilt (both hectorites); Barasym NAS-100, Barasym NAH-100, Barasym SMM 200, and Barasym LIH-300, all synthetic hectorites and saponites marketed by Baroid Division, NL, Industries, Inc.

Smectite clays are highly preferred for use in the instant invention. Montmorillonite, hectorite and saponite are the preferred smectites. Gelwhite GP, Barasum NAS-100, Barasym NAH-100, and Veegum F are the preferred montmorillonites, hectorites and saponites.

A second type of expandable clay material useful in the instant invention is classified geologically as attapulgite (palygorskite). Attapulgites are magnesium-rich clays having principles of superposition of tetrahedral and octahedral unit cell elements different from the smectites. An idealized composition of the attapulgite unit cell is given as: $(OH_2)_4(OH)_2Mg_5Si_8O_{20}\cdot 4H_2O$.

A typical attapulgite analysis yields 55.02% $SiO_2$; 10.24% $Al_2O_3$; 3.53% $Fe_2O_3$; 10.49% MgO; 0.47% $K_2O$; 9.73% $H_2O$ removed at 150° C; 10.13% $H_2O$ removed at higher temperatures.

Like the smectites, attapulgite clays are commercially available. For example, such clays are marketed under the trade name Attagel, i.e. Attagel 40, Attagel 50 and Attagel 150 from Engelhard Minerals & Chemicals Corporation.

Particularly preferred for the colloid-forming component in certain embodiments of the instant composition are mixtures of smectite and attapulgite clays. With higher abrasive levels, i.e. above about 20% by weight, such a clay mixture provides compositions which have false body properties surprisingly more desirable than compositions prepared with either smectite or attapulgite alone. In general, such mixed clay compositions exhibit increased and prolonged fluidity upon application of shear stress but are still adequately thickened solutions at times when flow is not desired. Clay mixtures in a smectite/attapulgite weight ratio of from 4:1 to 1:5 are preferred. Ratios of from 2:1 to 1:2 are more preferred. A ratio of about 1:1 is most preferred.

As noted above, the clays employed in the compositions of the present invention contain cationic counter ions such as protons, sodium ions, potassium ions, calcium ions, magnesium ions and the like. It is customary to distinguish between clays on the basis of one cation which is predominately or exclusively absorbed. For example, a sodium clay is one in which the absorbed cation is predominately sodium. Such absorbed cations can become involved in exchange reactions with cations present in aqueous solutions.

Clay materials obtained under the forgoing commercial trade name can comprise mixtures of the various discrete mineral entities. Such mixtures of the minerals are suitable for use in the present compositions. In addition, natural clays sometimes consist of particles in which unit layers of different types of clay minerals are stacked together (interstratification). Such clays are called mixed layer clays, and these materials are also suitable for use herein.

The colloid-forming clay materials useful in the instant invention are described more fully in H. van Olphen, "Clay Minerology," *An Introduction to Clay Colloid Chemistry*, Interscience Publishers, 1963; pp 54–73 and Ross and Hendricks, "Minerals of the Montmorillonite Group" *Professional Paper* 205B of the United States Department of the Interior Geological Survey, 1945; pp 23–79; both articles being incorporated herein by reference.

The colloid-forming agent is present in the false body fluid phase of the instant compositions to the extent that the concentration of colloid-forming agent ranges from about 1% to 10% by weight, preferably from about 3% to 5% by weight, of the total composition.

ABRASIVE MATERIAL

Another essential element of the instant compositions is relatively heavy, water-insoluble particulate abrasive material which is suspended throughout the false body fluid phase. Such insoluble materials have particle size diameters ranging from about 1 to about 250 microns and have specific gravity equal to or greater than that of the false body phase. It is preferred that the diameters of the particles range from about 2 microns to about 60 microns and that their specific gravity range from about 1.1 to about 5.0. Insoluble abrasive particulate material of this size and specific gravity can easily be suspended in the false body scouring compositions of the instant invention in their quiescent state.

These abrasives which can be utilized include, but are not limited to, quartz, pumice, pumicite, titanium dioxide ($TiO_2$), silica sand, calcium carbonate, calcium phosphate, zirconium silicate, diatomaceous earth, whiting, perlite, tripoli, melamine, urea formaldehyde and feldspar. Mixtures of different types of abrasive material can also be employed. Silica sand and perlite are the preferred abrasives for use in the instant compositions.

The relatively heavy, water insoluble particulate abrasive material is suspended throughout the false body fluid phase such that the abrasive material concentration ranges from about 2% to about 60% by weight, preferably from about 4% to 30% by weight, of the instant compositions.

FILLER MATERIAL

Another essential element of the instant compositions is relatively light, water-insoluble particulate filler material which is, like the abrasive material, suspended throughout the false body fluid phase. Such insoluble materials have particle size diameters ranging from about 1 to about 250 microns and have specific gravity less than that of the false body fluid phase. It is preferred that the diameters of the filler particles range from about 2 microns to about 60 microns and that their specific gravity range from about 0.2 to about 1.1.

Although the instant invention is not limited to any particular theory or mechanism, it is believed that inclusion of the relatively light, insoluble filler material in the false body fluid phase helps in two ways to minimize formation of a clear liquid layer above the instant false body abrasive compositions in their containers. First, the filler material, by virtue of its buoyancy in the false body phase, exerts an upward force on the structure of the colloid-forming agent in the false body phase. This upward force counteracts the tendency of the heavy abrasive to compress the false body structure and squeeze out liquid. Secondly, the filler material acts as a bulking agent replacing a portion of the water which would normally be used in the instant compositions in the absence of such filler material. Thus less aqueous liquid is available to cause clear layer formation and separation.

The light density filler materials which can be utilized include, but are not limited to, powdered plastic and polymeric materials such as powdered polyethylene, powdered polypropylene, powdered polystyrene, powdered polyester resin, powdered phenolic resin and powdered polysulfide; expanded perlite; glass microspheres and hollow glass microballoons. These materials are marketed under such tradenames as Q-CEL (marketed by Philadelphia Quartz Company); HERCOFLAT (marketed by Hercules, Incorporated); and ECCOSPHERES and MICROBALLOONS (marketed by Emerson & Cuming, Inc.).

Generally, such light density filler particles should be approximately equal in size to the particles of abrasive material. Therefore, the ratio of the average particle diameters of the relatively heavy abrasive material and the relatively light filler material should range from about 0.25:1 to 2.0:1, preferably from about 0.5:1 to 1.5:1.

The relatively light, water-insoluble particulate filler material is suspended throughout the false body fluid phase such that the filler material concentration ranges from about 1% to 15% by weight, preferably from about 1.5% to 3.0% by weight, of the total composition.

It should be noted that the water-insoluble, relatively light particulate filler material can have hardness values such that the filler material also exhibits some abrasive or scouring function in the instant compositions. Some heavier abrasive material of the higher specific gravity described above remains, however, an essential component of the present compositions. This is true even if the filler material also incidentally contributes to abrasive scouring.

In a particularly preferred embodiment of the present invention, both the relatively heavy abrasive material and the relatively light filler material can be made of a single substance, expanded perlite. Perlite itself is a naturally-occurring siliceous volcanic mineral. A typical chemical analysis of perlite is shown as follows:

Typical Perlite Analysis

| | | |
|---|---|---|
| Silicon dioxide | ($SiO_2$) | 71–75% |
| Aluminum oxide | ($Al_2O_3$) | 12.5–18.0% |
| Potassium oxide | ($K_2O$) | 4.0–5.0% |
| Sodium oxide | ($Na_2O$) | 2.9–4.0% |

-continued

| Typical Perlite Analysis | | |
|---|---|---|
| Calcium oxide | (CaO) | 0.5–2.0% |
| Ferric oxide | ($Fe_2O_3$) | 0.5–1.5% |
| Magnesium oxide | (MgO) | 0.1–0.5% |
| Titanium dioxide | ($TiO_2$) | 0.03–0.2% |
| Manganese dioxide | ($MnO_2$) | 0.03–0.1% |
| Sulfur trioxide | ($SO_3$) | 0–0.2% |
| Ferrous oxide | (FeO) | 0–0.1% |
| Chronium | (Cr) | 0–0.1% |
| Barium | (Ba) | 0–0.05% |
| Lead Oxide | (PbO) | 0–0.03% |
| Nickel Oxide | (NiO) | Trace |
| Copper | (Cu) | Trace |
| Boron | (B) | Trace |
| Beryllium | (Be) | Trace |
| Molybdenum | (Mo) | Trace |
| Arsenic | ($As_2O_3$) | <0.1 ppm |
| Free silica | | 0–2% |

The perlite which is useful as both the abrasive material and light filler material herein is expanded perlite. Expansion of perlite is accomplished by heating the raw material to a point within its softening range of from 1600° – 2000° F in order to expand the mineral to the extent of from four to twenty times its original volume. During the expansion process, bubbles of water vapor are trapped within the molten perlite. Upon cooling and crushing, these bubbles are retained within some of the expanded perlite particles. Perlite expansion methods are described more fully in Howle; U.S. Pat. No. 2,572,483; issued Oct. 23, 1951 and Maxey; U.S. Pat. No. 2,935,267; issued May 3, 1960; both patents being incorporated herein by reference.

The presence of trapped water vapor bubbles within expanded perlite produces an abrasive mixture in which some particles have specific gravity of 1.0 to 1.2 or less and in which some particles have specific gravity greater than 1.0 to 1.2.

Examples of commercially-available expanded perlite suitable for use as the abrasive, the light filler material or, in the preferred embodiments of the instant invention, both the heavy abrasive and the light filler are those materials having the trade name TERRA-FIL, marketed by the Johns-Manville Products Corporation and those materials having the trade name SUPERFINES marketed by Silbrico Corporation.

Grades X-2, X-3, X-4 and X-5 of the TERRA-FIL products have average specific gravity greater than about 1.2 and are hence particularly useful as the abrasive material in the compositions of the present invention. TERRA-FIL Grade X-4, for example, is a highly preferred material of this type. This particular expanded perlite has an average specific gravity of about 1.7 and a typical screen analysis shown as follows:

| TERRA-FIL X-4 | |
|---|---|
| SCREEN | Wt. % |
| On 65 | 2.0 |
| On 100 | 6.0 |
| On 200 | 46.0 |
| On 325 | 29.0 |
| Fines | 13.0 |
| Lost | 4.0 |

"SUPERFINES" marketed by Silbrico Corporation has an average specific gravity below about 1.0 and hence is particularly useful as the filler material in compositions of the present invention. SUPERFINES, for example, has an average specific gravity of about 0.7 and a typical screen analysis shown as follows:

| SUPERFINES | |
|---|---|
| SCREEN | Wt. % |
| On 100 | 14.8 |
| On 150 | 8.83 |
| On 200 | 16.08 |
| On 325 | 21.5 |
| Thru 325 | 39.09 |

OPTIONAL MATERIALS

Useful scouring compositions can be prepared utilizing only the above-described abrasive material, filler material, and false body fluid phase comprising the colloid-forming agent and aqueous liquid. Generally, however, commercial scouring cleansers will contain a number of additional ingredients to enhance their performance or aesthetics. Such materials are optional ingredients in the instant compositions and include bleaching agents, surfactants, buffering agents, builder compounds, coloring agents and perfume. These optional ingredients are discussed in detail as follows:

BLEACHING AGENT

The instant compositions can optionally include a bleaching agent. Any suitable bleaching agent which yields active chlorine or active oxygen in aqueous solution can be employed.

A highly preferred bleaching agent is one which yields a hypochlorite species in aqueous solution. The hypochlorite ion is chemically represented by the formula $OCl^-$. The hypochlorite ion is a strong oxidizing agent and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e. one molecule of chlorine gas.

At lower pH levels, aqueous solutions formed by dissolving hypochlorite-yielding compounds contain active chlorine partially in the form of hypochlorous acid moieties and partially in the form of hypochlorite ions. At pH levels above about 10, i.e. at the preferred pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanruate dihydrate, trichlorocyanuric acid, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding bleaching agents are available in solid or concentrated form and are dissolved in water during synthesis of the compositions of the instant invention. Some of the above materials are available as aqueous solutions.

If present, the above-described bleaching agents are dissolved in the aqueous liquid component used to form the false body fluid phase. Bleaching agents can generally comprise from about 0.1% to 10% by weight, preferably from about 0.5% to 2.0% by weight, of the total composition.

SURFACTANT

Another highly preferred optional ingredient for use in the present compositions is a surfactant component. Such surfactants are highly preferred within scouring cleansers such as those of the instant invention in order to render such compositions more effective for removal of soil and stains from hard surfaces.

Any surfactant which is compatible with the other composition components can be employed. These include water-soluble anionic, nonionic, ampholytic, cationic and zwitterionic surfactants.

In highly preferred composition embodiments, the surfactant selected for use must be stable against chemical decomposition and oxidation by any bleaching agents which might also be present. Accordingly, surfactant materials which are to be used in compositions containing bleach (especially hypochlorite bleach) must contain no functionalities (such as ether linkages, unsaturation, some aromatic structures, or hydroxyl groups) which are susceptible to oxidation by the bleaching species. Thus many of the commonly employed surfactant materials of the prior art, i.e., alkyl benzene sulfonates, olefin sulfonates, alkyl glyceryl ether sulfonates, alkyl ether sulfates and ethoxylated nonionic surfactants are to be avoided in the compositions of the instant invention which optionally contain strong bleach.

Bleach-stable surfactants which are especially resistant to hypochlorite oxidation fall into two main groups. One such class of bleach-stable surfactants are the water-soluble alkyl sulfates containing from about 8 to 18 carbon atoms in the alkyl group. Alkyl sulfates are the water-soluble salts of sulfated fatty alcohols. They are produced from natural or synthetic fatty alcohols containing from about 8 to 18 carbon atoms. Natural fatty alcohols include those produced by reducing the glycerides of naturally occurring fats and oils. Fatty alcohols can also be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable surfactant materials highly preferred for use in the compositions of the instant invention which contain hypochlorite bleach are the water-soluble betaine surfactants. These materials have the general formula:

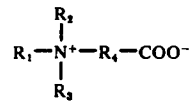

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and are hence not preferred for optional inclusion in the instant compositions.)

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dedecyldimethylammonium hexanoate, hexadecyldimethylammonium hexanoate, tetradecyldiethylammonium pentanoate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

If present, the above-described surfactant materials are dissolved in the aqueous liquid component used to form the false body fluid phase. Surfactants can generally comprise from about 0.1 % to 6.0 % by weight, preferably from about 0.25% to 1.0% by weight, of the total composition.

BUFFERING AGENT

When the instant scouring composition contains such optional ingredients as bleach and surfactant, it is generally desirable to also include a buffering agent capable of maintaining the pH of the instant compositions within the alkaline range. It is in this pH range that optimum performance of the bleach and surfactant are realized, and it is also within this pH range wherein optimum composition chemical stability is achieved.

When the essential colloid-forming agent is a clay material and when a hypochlorite bleach is optionally included in the instant compositions, it has been surprisingly discovered that maintenance of the composition pH within the 10.5 to 12.5 range minimizes undesirable chemical decomposition of the active chlorine, hypochlorite-yielding bleaching agents, said decomposition generally being encountered when such bleaching agents are admixed with clay in unbuffered aqueous solution. Maintenance of this particular pH range also minimizes the chemical interaction between the strong hypochlorite bleach and the surfactant compounds optionally present in the instant compositions. Finally, as noted, high pH values such as those maintained by an optional buffering agent serve to enhance the soil and stain removal properties of the surfactant during utilization of the present compositions.

Any compatible material or mixture of materials which has the effect of maintaining composition pH within the alkaline pH range, and preferably within the 10.5 to 12.5 range, can be utilized as the optional buffering agent in the instant invention. Such materials can include, for example, various water-soluble, inorganic salts such as the carbonates, bicarbonates, sesquicarbonates, silicates, pyrophosphates, phosphates, tetraborates, and mixtures thereof. Examples of materials which can be used either alone or in combination as the buffering agent herein include sodium carbonate, sodium bicarbonate, potassium carbonate, sodium sesquicarbonate, sodium silicate, tetrapotassium pyrophosphate, tripotassium phosphate, trisodium phosphate, anhydrous sodium tetraborate, sodium tetraborate pentahydrate and sodium tetraborate decahydrate. Preferred buffering agents for use herein include mixtures of tetrapotassium pyrophosphate and trisodium phosphate in a pyrophosphate/phosphate weight ratio of about 3:1, mixtures of tetrapotassium pyrophosphate and tripotassium phosphate in a pyrophosphate/phosphate weight ratio of about 3:1, and mixtures of anhydrous sodium carbonate and sodium silicate in a carbonate/metasilicate weight ratio of about 3:1.

As will be discussed hereinafter, it is also highly preferred to include in the instant compositions a material which acts as a detergency builder, i.e. a material which reduces the free calcium and/or magnesium ion concentration in a surfactant-containing aqueous solution. Some of the above-described buffering agent materials additionally serve as builder materials. Such compounds as the carbonates, phosphates and pyrophosphates are of this type. Other buffering agent components such as the silicates and tetraborates perform no building function.

Since presence of a builder in the instant compositions is highly desirable, it is preferred that the optional buffering agent contain at least one compound capable of additionally acting as a builder, i.e. capable of lowering the free calcium and/or magnesium ion content of an aqueous solution containing such ions.

If present, the above-described buffering agent materials are dissolved in the aqueous liquid component used to form the false body fluid phase. Buffering agents can generally comprise from about 2% to 15% by weight, preferably from about 5% to 8% by weight, of the total composition.

OTHER OPTIONAL MATERIALS

In addition to the above-described bleach, surfactant and buffering agent optional components, the instant scouring compositions can contain other non-essential materials to enhance their performance, stability, or aesthetic appeal. Such materials include optional non-buffering builder compounds, coloring agents and perfumes. Although, as noted above, some of the above-described buffering agents can function as builder compounds, it is possible to add other builder compounds which either alone or in combination with other salts do not buffer within the preferred pH range. Typical of these optional builder compounds which do not necessarily buffer within the highly preferred 10.5 –12.5 pH range are certain hexametaphosphates and polyphosphates. Specific examples of such optional builder materials include sodium tripolyphosphate, potassium tripolyphosphate and potassium hexametaphosphate.

Conventional coloring agents and perfumes can also be added to the instant compositions to enhance their aesthetic appeal and/or consumer acceptability. These materials should, of course, be those dye and perfume varieties which are especially stable against degradation by strong active chlorine bleaching agents if such bleaching agents are also present.

If present, the above-described other optional materials generally comprise no more than about 5% by weight of the total composition and are dissolved, suspended or emulsified in the aqueous liquid component used to form the false body fluid phase of the instant compositions.

COMPOSITION PREPARATION

The scouring compositions of the instant invention can be prepared by admixing the above-described essential and optional components together in the appropriate concentrations in any order by any conventional means normally used to form colloidal compositions. Some shear agitation is, of course, necessary to insure preparation of compositions of the requisite false body character. The extent of shear agitation, in fact, can be used to vary as desired the nature of the false-bodied compositions so prepared.

In a particularly preferred procedure for preparing the instant compositions, a certain order of addition of components and certain types of shear agitation can be employed to provide compositions having exceptionally desirable abrasive suspension and phase separation properties. In such a procedure, the false body fluid phase is formed by admixing water, colloid-forming agent, dye, perfume and perhaps a small amount of builder under relatively high shear agitation. Surfactant and additional builder can then be blended into the false body phase. A separate aqueous slurry of bleach, abrasive and filler is then prepared and added to the false body phase under moderate shear to provide a uniform and homogeneous false body composition.

The false body scouring cleanser compositions of the instant invention are illustrated by the following examples:

EXAMPLE I

A false body hard surface scouring cleanser of the following composition is prepared:

| COMPONENT | | Wt. % |
|---|---|---|
| False Body Fluid Phase (Specific Gravity 1.1) | | 93.5 |
| Barasum NAS-100 (Sodium Saponite Clay) | 4.25% | |
| Tetrapotassium Pyrophosphate | 6.0% | |
| Tripotassium Phosphate | 2.0% | |
| Sodium Hypochlorite Bleach | 0.9% | |
| Sodium Lauryl Alkyl Sulfate Surfactant | 0.25% | |
| Dye and Perfume | 0.26% | |
| Soft Water | 79.863% | |
| Abrasive (Expanded Perlite-Specific Gravity 2.0 Average Particle Diameter 50 microns) | | 5.0 |
| Hercoflat 135 Filler (powdered polypropylene, Specific Gravity 0.9 Average Particle Diameter 35 microns) | | 1.50 |
| | | 100.00% |

Ratio Average Particle Diameter Abrasive/Filler = 1.43:1

The above-described Example I composition is prepared by mixing tetrapotassium pyrophosphate, tripotassium phosphate, sodium saponite clay, dye, perfume and deionized water using relatively high shear agitation to the extent necessary to form a false body fluid phase. The alkyl sulfate surfactant is then blended in to this mixture followed by the polypropylene filler material. A separate aqueous slurry of sodium hypochlorite and perlite abrasive is prepared and then blended into the false body fluid phase while it is being liquified under moderate shear agitation.

The resulting above-described Example I scouring composition is false bodied, i.e. gel-like in its quiescent state but easily fluidized by application of shear stress. In its quiescent state, the composition maintains the perlite abrasive and powdered polypropylene filler in a uniformly suspended dispersion. When applied to horizontal or vertical hard surfaces, the composition is not fluid and does not appreciably run along such surfaces.

Such a composition exhibits negligible clear layer separation and negligible bleach and/or surfactant decomposition over a storage period of six weeks. Such a composition is especially effective for removal of stains and soil from hard surfaces.

Compositions of substantially similar chemical, physical and performance properties are realized when in the above-described Example I composition the Barasym NAS-100 sodium saponite is replaced with equivalent amounts of Gelwhite GP, Barasym NAH-100, Veegum F or mixtures of Barasym NAS-100 and Attagel 150.

Compositions of substantially similar chemical, physical and performance properties are realized when in the above-described Example I composition, the pyrophosphate/phosphate buffer/builder mixture is replaced with equivalent amounts of sodium carbonate, potassium carbonate, sodium metasilicate, trisodium phosphate, tripotassium phosphate, a mixture of tetrapotassium pyrophosphate and trisodium phosphate in a pyrophosphate/phosphate weight ratio of about 3:1, a mixture of anhydrous sodium carbonate and sodium metasilicate in a carbonate/metasilicate weight ratio of 3:1 or a mixture of tetrapotassium pyrophosphate and potassium carbonate in a pyrophosphate/carbonate weight ratio of about 3:1.

Compositions of substantially similar chemical, physical and performance properties are realized when in the above-described Example I composition the expanded perlite abrasive material is replaced with equivalent amounts of quartz, pumice, pumicite, titanium dioxide, silica sand, calcium carbonate, calcium phosphate, zirconium silicate, diatomaceous earth, whiting, tripoli, melamine, urea formaldehyde or feldspar of approximately the same density and particle size as the expanded perlite.

Compositions of substantially similar chemical, physical and performance properties are realized when in the above-described Example I composition, the Hercoflat powdered polypropylene is replaced with equivalent amounts of powdered polyethylene, powdered polystyrene, powdered polyester resin, powdered phenolic resin, powdered polysulfide, expanded perlite, glass microspheres or hollow glass microballoons of approximately the same density and particle size as the Hercoflat.

Compositions of substantially similar chemical, physical and performance properties are realized when in the above-described Example I composition the expanded perlite abrasive and Hercoflat powdered polypropylene are replaced with about 6.5% by weight of the composition of an expanded perlite mixture which contains about 61.5% by weight of material having specific gravity less than 1.1 and average particle size of 50 microns and about 38.5% by weight of material having specific gravity greater than 1.1 and average particle size of 75 microns.

CLEAR LAYER FORMATION TESTS

The Example I composition and several other similar compositions are compared for clear layer formation with a control composition containing no powdered polypropylene filler material. In addition to the Example I composition, compositions of the instant invention are prepared which contain all the components of the Example I composition but with the following variations:

| Composition No. | Variation |
|---|---|
| A | 2 wt. % clay-5 wt. % powdered polypropylene |
| B | 1.5 wt. % clay-8 wt. % powdered polypropylene |
| C | 2 wt. % clay-8 % powdered polypropylene |
| D | 2.5 wt. % clay-5 % powdered polypropylene |
| Control | 3.5 wt. % clay-No powdered polypropylene |

All compositions are prepared in the manner outlined for the Example I composition and are then placed without agitation in 500 milliliter beakers and allowed to stand for a period of days. Such testing is conducted both at ambient temperature and at 100° F.

After one day the control composition containing no powdered polypropylene filler material begins to exhibit a measurable clear layer in the beaker at the top of the false body phase under both sets of temperature conditions. After 25 days, none of the compositions of the present invention containing the powdered polypropylene filler material exhibit measurable clear layer formation under either set of temperature conditions.

Such testing demonstrates the especially desirable phase stability of compositions of the instant invention in comparison with compositions not containing the requisite relatively light density filler material of the claimed compositions.

What is claimed is:

1. An aqueous false-body hard-surface scouring composition having reduced tendency to form a liquid layer above said false-body compositions, said composition consisting essentially of:

A. a continuous false-body fluid phase formed by admixing an aqueous liquid with an organic or inorganic colloid-forming agent capable of forming said liquid phase into a false-body fluid, such that the concentration of aqueous liquid ranges from about 30% to 90% by weight of the total composition and the concentration of the colloid-forming agent ranges from about 1% to 10% by weight of the total composition;

B. relatively heavy, water-insoluble particulate abrasive material having particle diameters ranging from one micron to about 250 microns and a specific gravity equal to or greater than that of the continuous false body phase, said relatively heavy abrasive material being suspended throughout said continuous false-body fluid phase to the extent that the total concentration of relatively heavy abrasive material ranges from 2% to about 60% by weight of the total composition; and C. relatively light, water-insoluble particulate filler material having particle diameters ranging from one micron to about 250 microns and a specific gravity less that that of the continuous false body phase, said relatively light particulate material being suspended throughout said continuous false body fluid phase to the extent that the concentration of relatively light particulate material ranges from about 1% to 15% by weight of the total composition;

wherein the ratio of the average particle diameters of the relatively heavy abrasive material and the relatively light filler material ranges from 0.25:1 to 2.1:1.

2. A composition in accordance with claim 1 wherein the colloid-forming agent is in inorganic clay selected from the group consisting of smectites, attapulgites and mixtures of smectites and attapulgites.

3. A composition in accordance with claim 2 wherein the abrasive particulate material has a specific gravity of from about 1.1 to 5.0 and the particulate filler material has a specific gravity of from about 0.2 to about 1.1

4. A composition in accordance with claim 3 wherein the inorganic clay is present at from about 3% to 5% by weight of the total composition, the abrasive particulate material comprises from about 4% to 30% by weight of the total composition, and the particulate filler material is present at from about 1.5% to 3.0% by weight of the total composition.

5. A composition in accordance with claim 4 wherein

A. the colloid-forming clay is a smectite clay selected from the group consisting of montmorillonites, volchonskoites, nontronites, beidellites, hectorites, saponites, sauconites and vermiculites;

B. the insoluble abrasive particulate material is selected from the group consisting of quartz, pumice, pumicite, titanium dioxide, silica sand, calcium carbonate, calcium phosphate, zirconium silicate, diatomaceous earth, whiting, perlite, tripoli, melamine, urea formaldehyde and feldspar; and C. the insoluble particulate filler material is selected from the group consisting of powdered polyethylene, powdered polypropylene, powdered polystyrene, powdered polyester resin, powdered phenolic resin, powdered polysulfide, expanded perlite, glass microspheres and hollow glass microballoons.

6. A composition in accordance with claim 2 which additionally contains dissolved in the aqueous liquid used to form the false body fluid phase optional components selected from the group consisting of:

A. a bleaching agent which yields hypochlorite species in aqueous solution; said bleaching agent, if present, being from about 0.1% to 10% by weight of the total composition;

B. a surfactant selected from the group consisting of water-soluble anionic, nonionic, ampholytic, cationic and zwitterionic surfactants; said surfactant, if present, being from about 0.1% to 6.0% by weight of the total composition;

C. a compatible buffering agent capable of maintaining the pH of the false body composition within the alkaline range; said buffering agent, if present, being from about 2% to 15% by weight of the total composition; and D. mixtures of said bleaching agent, surfactant and buffering agent.

7. A composition in accordance with claim 4 which additionally contains dissolved in the aqueous liquid used to form the false body fluid phase;

A. a bleaching agent which yields a hypochlorite species in aqueous solution present to the extent of from about 0.5% to 2.0% by weight of the total composition;

B. from about 0.25% to about 1.0% by weight of the total composition of a bleach-stable surfactant which is a water-soluble alkyl sulfate containing from about 8 to about 18 carbon atoms in the alkyl group; and C. a compatible inorganic buffering agent capable of maintaining composition pH within the range of from about 10.5 to 12.5; said buffering agent being present to the extent of from about 5% to 8% by weight of the total composition.

8. A composition in accordance with claim 7 wherein:

A. the colloid-forming clay is a smectite clay selected from the group consisting of montmorillonites, volchonskoites, nontronites, beidellites, hectorites, saponites, sauconties and vermiculites;

B. the insoluble abrasive particulate material is selected from the group consisting of quartz, pumice, pumicite, titanium dioxide, silica sand, calcium carbonate, calcium phosphate, zirconium silicate, diatomaceous earth, whiting, perlite, tripoli, melamine, urea formaldehyde and feldspar; and C. the insoluble particulate filler material is selected from the group consisting of powdered polyethylene, powdered polypropylene, powdered polystyrene, powdered polyester resin, powdered phenolic resin, powdered polysulfide, expanded perlite, glass microspheres and hollow glass microballoons.

9. A composition in accordance with claim 3 wherein

A. the bleaching agent is selected from the group consisting of sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, trichlorocyanuric acid, 1,3-dichloro-5,5-dimethylhydantoin, N-chlorosulfamide, Chloramine T, Dichloramine T, Chormaine B and Dichloramine B;

B. the bleach stable surfactant is selected from the group consisting of sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures thereof; and C. the buffering agent is selected from the group consisting of sodium carbonate, potassium carbonate, sodium metasilicate, trisodium phosphate, tripotassium phosphate, a mixture of tetrapotassium pyrophosphate and tripotassium phosphate in a pyrophosphate/phosphate weight ratio of about 3.1, a mixture of tetrapotassium pyrophosphate and trisodium phosphate in a pyrophosphate/phosphate weight ratio of about 3:1, a mixture of anhydrous sodium carbonate and sodium metasilicate in a carbonate/metasilicate weight ratio of 3:1 and a mixture of tetrapotassium pyrophosphate and potassium carbonate in a pyrophosphate/carbonate weight ratio of about 3:1.

10. A composition in accordance with claim 1 wherein both the relatively heavy abrasive material and relatively light filler material are expanded perlite.

11. A composition in accordance with claim 6 wherein both the relatively heavy abrasive material and relatively light filler material are expanded perlite.

* * * * *